US006221816B1

(12) United States Patent
Kasuga et al.

(10) Patent No.: US 6,221,816 B1
(45) Date of Patent: Apr. 24, 2001

(54) DETERGENT COMPOSITION COMPRISING A MONOGLYCERYL ETHER

(75) Inventors: Kennichi Kasuga, Tokyo; Tetsuya Miyajima, Wakayama, both of (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 09/457,333

(22) Filed: Dec. 9, 1999

(30) Foreign Application Priority Data

Dec. 25, 1998 (JP) ..... 10-370654
Oct. 12, 1999 (JP) ..... 11-289878

(51) Int. Cl.[7] ..... C11D 1/72; C11D 3/37

(52) U.S. Cl. ..... 510/119; 510/122; 510/123; 510/125; 510/128; 510/130; 510/135; 510/466; 510/490; 510/421; 510/426; 510/356

(58) Field of Search ..... 510/119, 122, 510/123, 125, 128, 130, 135, 466, 490, 421, 426, 356

(56) References Cited

U.S. PATENT DOCUMENTS 4,879,107 * 11/1989 Vanlerberghe et al. ..... 424/70
5,753,138 * 5/1998 Watson et al. ..... 252/186.1
5,863,945 * 1/1999 Murayama et al. ..... 514/563
6,008,183 * 12/1999 Morioka et al. ..... 510/506

FOREIGN PATENT DOCUMENTS

4140474 * 6/1993 (DE) .
41 40 474 6/1993 (DE) .
43 39 368 5/1995 (DE) .
0 487 262 5/1992 (EP) .
2755852 * 5/1998 (FR) .
2 755 852 5/1998 (FR) .
00/00164 1/2000 (WO) .

* cited by examiner

*Primary Examiner*—Yogendra Gupta
*Assistant Examiner*—Charles Boyer
(74) *Attorney, Agent, or Firm*—Oblon, Spivak, McClelland, Maier & Neustadt, P.C.

(57) ABSTRACT

The invention relates to a detergent composition comprising (A) 0.5 to 60% by weight of a surfactant selected from the group consisting of anionic surfactants, nonionic surfactants and amphoteric surfactants, (B) 0.01 to 20% by weight of a conditioning component, and (C) 0.1 to 30% by weight of a monoglyceryl ether having a linear or branched alkyl or alkenyl group having 4 to 12 carbon atoms. The composition is excellent in foaming performance, gives users a pleasant feeling upon use and brings about a sufficient conditioning effect on the skin and hair.

11 Claims, No Drawings

DETERGENT COMPOSITION COMPRISING A MONOGLYCERYL ETHER

FIELD OF THE INVENTION

The present invention relates to detergent compositions which have excellent foam performance, give users a pleasant feeling upon use and bring about a sufficient conditioning effect on the skin and hair.

BACKGROUND OF THE INVENTION

In order to prevent hair creakiness during rinsing and hair crispness after drying, various conditioning components are incorporated into hair detergent compositions containing various kinds of surfactants. When the conditioning components are used in combination, however, foaming performance such as foaming power, foam quality and foaming stability may be deteriorated in some cases.

On the other hand, conditioning components such as an oily substance may be incorporated even in other detergent compositions than the hair detergent compositions for the purpose of improving a feeling upon use to the skin. Even in this case, however, there has been a problem that foaming power, foam quality and the like are deteriorated like the above.

SUMMARY OF THE INVENTION

It is an object of the present invention to provide a detergent composition which gives users a pleasant feeling upon use and brings about a sufficient conditioning effect on the skin and hair without impairing foaming power and foaming performance.

The present inventors have found that when a surfactant, a conditioning component and a specific monoglyceryl ether are used in combination, a detergent composition which has excellent foaming power and foaming performance, gives users a pleasant feeling upon use and brings about a sufficient conditioning effect on the skin and hair can be provided.

According to the present invention, there is thus provided a detergent composition comprising the following components (A), (B) and (C):

(A) 0.5 to 60% by weight of a surfactant selected from the group consisting of anionic surfactants, nonionic surfactants and amphoteric surfactants;

(B) 0.01 to 2% by weight of a conditioning component; and (C) 0.1 to 30% by weight of a monoglyceryl ether having a linear or branched alkyl or alkenyl group having 4 to 12 carbon atoms.

The detergent composition according to the present invention is excellent in foaming performance such as foaming power and foam quality, gives users a pleasant feeling upon use and brings about a sufficient conditioning effect on the skin and hair.

The above and other objects, features and advantages of the present invention will be readily appreciated as the same becomes better understood from the preferred embodiments of the present invention, which will be described subsequently in detail, and from the appended claims.

DETAILED DESCRIPTION OF THE PREFERRED EMBODIMENTS

The surfactant (A) useful in the practice of the present invention is at least one selected from the group consisting of anionic surfactants, nonionic surfactants and amphoteric surfactants.

The anionic surfactants are preferably those of sulfate, sulfonate and carboxylate types, and examples thereof include alkylsulfates, polyoxyalkylene alkyl ether sulfates, polyoxyalkylene alkenyl ether sulfates, alkyl sulfosuccinates, alkyl polyoxyalkylene sulfosuccinates, polyoxyalkylene alkyl phenyl ether sulfates, higher fatty acid salts and alkanesulfonates.

Of these, polyoxyalkylene alkyl ether sulfates, polyoxyalkylene alkenyl ether sulfates and alkylsulfates are preferred, with those represented by the general formula (1) or (2):

$$R^1O(CH_2CH_2O)_mSO_3M \quad (1)$$

$$R^2OSO_3M \quad (2).$$

wherein $R^1$ is an alkyl or alkenyl group having 10 to 18 carbon atoms, $R^2$ is an alkyl group having 10 to 18 carbon atoms, M is an alkali metal, alkaline earth metal, ammonium, alkanolamine or basic amino acid, and m is a number 1 to 5 on the weight average, being particularly preferred.

Examples of the nonionic surfactant include polyoxyalkylene sorbitan fatty acid esters, polyoxyalkylene sorbit fatty acid esters, polyoxyalkylene glycerol fatty acid esters, polyoxyalkylene fatty acid esters, polyoxyalkylene alkyl ethers, polyoxyalkylene alkyl phenyl ethers, polyoxyalkylene (hardened) castor oil, sucrose fatty acid esters, polyglycerol alkyl ethers, polyglycerol fatty acid esters, fatty acid alkanolamides and alkyl polyglycosides. Of these, alkyl glycosides, polyoxyalkylene ($C_8$–$C_{20}$) fatty acid esters, polyoxyethylene sorbitan fatty acid esters, polyoxyalkylene hardened castor oil and fatty acid alkanolamides are preferred. The fatty acid alkanolamides are preferably those having an acyl group having 8 to 18, particularly 10 to 16 carbon atoms. The fatty acid alkanolamides may be either monoalkanolamides or dialkanolamides and are preferably those having a hydroxyalkyl group having 2 or 3 carbon atoms. Examples thereof oleic acid diethanolamide, palm kernel fatty acid diethanolamide, coconut fatty acid diethanolamide, lauric acid diethanolamide, polyoxyethylene coconut fatty acid monoethanolamide, coconut fatty acid monoethanolamide, lauric acid isopropanolamide and lauric acid monoethanolamide.

The amphoteric surfactants include betaine type surfactants. Of these, betaine type surfactants such as alkyldimethylaminoacetic acid betaines and fatty acid amide propylbetaines are preferred, with fatty acid amide propylbetaines being particularly preferred. The fatty acid amide propylbetaines are preferably those having an acyl group having 8 to 18, particularly 10 to 16 carbon atoms, with lauric acid amide propylbetaine, palm kernal fatty acid amide propylbetaine, coconut fatty acid amide propylbetaine, etc. being particularly preferred.

The surfactant (A) preferably comprises an anionic surfactant and contains an nonionic surfactant and/or an amphoteric surfactant as needed. When the detergent composition according to the present invention is provided in the form of an aqueous liquid detergent, it is particularly preferred that a fatty acid amide propylbetaine or fatty acid alkanolamide is used in combination with the anionic surfactant in that not only the resultant detergent composition comes to have good foaming power, but also moderate liquid nature is achieved.

The component (A) is preferably incorporated in a proportion of 0.5 to 60% by weight, particularly 3 to 40% by weight into the detergent composition according to the present invention from the viewpoints of detergency and foaming performance. Of the component (A), the anionic surfactant is preferably incorporated in a proportion of 5 to 50% by weight, more preferably 8 to 30% by weight, particularly 10 to 22% by weight because a detergent composition having excellent detergency and foaming performance is provided. The nonionic surfactant is preferably incorporated in a proportion of 0 to 20% by weight, more preferably 0.5 to 10% by weight, particularly 1 to 5% by weight based on the total weight of the composition. The amphoteric surfactant is preferably incorporated in a proportion of 0 to 15% by weight, more preferably 0.5 to 10% by weight, particularly 1 to 5% by weight based on the total weight of the composition.

When the fatty acid amide propylbetaine and fatty acid alkanolamide are incorporated as described above, the incorporating amount thereof is preferably 0.1 to 10% by weight, particularly 1 to 8% by weight based on the total weight of the composition because a good foam-increasing effect is brought about.

Examples of the conditioning component (B) include oily substance, silicones and cationic polymers. The term "oily substances" as used herein means solid or liquid substances which are commonly used in the classical cosmetic compositions and can be dispersed in water, excluding silicones. Examples thereof include hydrocarbons such as vaseline; higher fatty acid monoesters such as isopropyl palmitate; higher alcohols such as cetyl alcohol; and vegetable and animal oils such as tsubaki oil, macadamia nut oil, mink oil, olive oil, safflower oil, soybean oil and jojoba oil. Of these, higher alcohols are preferred.

Examples of the silicones include the following silicones:

(1) dimethyl polysiloxane represented by the formula:

$$(Me_3)Si—(Me_2SiO)_d—Si(Me_3)$$

wherein Me is a methyl group, and d is a number of 3 to 2,000);

(2) amino-modified silicones:

Various kinds of amino-modified silicones may be used. However, those described under the name of Amodimethicone in a CTFA dictionary (Cosmetic Ingredient Dictionary; in America), third edition, and having an average molecular weight of about 3,000 to 100,000 are preferred. The amino-modified silicone is preferably used in the form of an aqueous emulsion. Examples of commercially available products thereof include SM 8704 (Toray Silicone Co., Ltd.) and DC 929 (Dow Corning Co.); and (3) besides, polyether-modified silicones, methylphenyl polysiloxane, acid acid-modified silicones, alcohol-modified silicones, alkoxy-modified silicones, epoxy-modified silicones, fluorine-modified silicones, cyclic silicones, alkyl-modified silicones, etc. may be mentioned.

Examples of the cationic polymers include cationized cellulose derivatives, cationic starch, cationized guar gum derivatives, homopolymers of diallyl quaternary ammonium salts, diallyl quaternary ammonium salt/acrylamide copolymers, quaternized polyvinyl pyrrolidone derivatives, polyglycol polyaminecondensates, vinylimidazolinium trichloride/vinylpyrrolidone copolymers, hydroxyethyl cellulose/dimethyldiallylammonium chloride copolymers, vinylpyrrolidone/quaternized dimethylaminoethyl methacrylate copolymers, polyvinyl pyrrolidone/alkyl aminoacrylate copolymers, polyvinyl pyrrolidone/alkyl aminoacrylate/vinylcaprolactam terpolymers, vinylpyrrolidone/methacrylamide propyl trimethylammonium chloride copolymers, alkylacrylamide/acrylate/alkyl aminoalkylacrylamide/polyethylene glycol methacrylate terpolymers, adipic acid/dimethylaminohydroxypropylethylenetriamine copolymers (Cartaretin, product of Sandoz Co. in America), and cationic polymers described in Japanese Patent Application Laid-Open Nos. 139734/1978 and 36407/1985. Cationized cellulose derivatives are particularly preferred.

These conditioning components of the component (B) may be used either singly or in any combination thereof and are preferably incorporated in a proportion of 0.01 to 20% by weight, particularly 0.1 to 10% by weight, more particularly 0.1 to 5% by weight based on the total weight of the composition. In particular, the combined use of the silicone and cationic polymer in respective proportions of 0.1 to 5% by weight are preferred in that a high conditioning effect can be brought about.

The components (A), (B) and (C) in the detergent compositions according to the present invention are preferably blended in the following weight ratio for reasons of the relationship among foaming power, foaming performance and a feeling upon use. A ratio of (B)/(A) is preferably 0.002 to 2, particularly 0.02 to 0.5. A ratio of (C)/(A) is preferably 0.002 to 2, particularly 0.02 to 0.5. A ratio of (C)/(B) is preferably 0.01 to 100, particularly 0.1 to 10.

The alkyl or alkenyl group in the monoglyceryl ether as the component (C) useful in the practice of the present invention is preferably that having 4 to 9 carbon atoms, with a linear or branched alkyl group having 4 to 8 carbon atoms being particularly preferred. More specifically, n-butyl, isobutyl, n-pentyl, 2-methylbutyl, isopentyl, n-hexyl, isohexyl, n-heptyl, n-octyl and 2-ethylhexyl groups, etc. are mentioned, with an octyl group being particularly preferred.

These monoglyceryl ethers of the component (C) may be used either singly or in any combination thereof and are preferably incorporated in a proportion of 0.1 to 30% by weight, particularly 0.5 to 15% by weight, more particularly 0.8 to 10% by weight based on the total weight of the composition because more sufficient foaming power is attained without impairing a feeling upon use and a conditioning effect.

In the detergent compositions according to the present invention, ingredients commonly used in the classical detergent compositions, for example, antidandruff agents, vitamins, germicides, antiphlogistics, preservatives, chelating agents, moisturizers such as propylene glycol, glycerol, diethylene glycol monoethyl ether, sorbitol and panthenol, colorants such as dyes and pigments, viscosity modifiers such as hydroxyethyl cellulose, methyl cellulose, polyethylene glycol, ethanol, clay minerals and salts such as sodium chloride, pH adjustors such as citric acid and potassium hydroxide, plant extracts, pearl-like-hue-imparting agents, perfume bases, colorants, ultraviolet absorbents, antioxidants, and besides ingredients described in ENCYCLOPEDIA OF SHAMPOO INGREDIENTS (MICELLE PRESS), may be suitably incorporated in addition to the above-described components.

The detergent compositions according to the present invention can be prepared in accordance with a method known per se in the art, and no particular limitation is imposed on the form thereof. The detergent compositions are thus provided in any optional form such as liquid, paste, cream, solid or powder. The detergent compositions are preferably provided in the form of liquid, paste or cream, with liquid detergent compositions being particularly preferred. When the detergent composition is provided in the form of liquid, it is preferable to use water or polyethylene glycol as a liquid medium. Water is preferably incorporated in a proportion of 10 to 80% by weight based on the total weight of the composition.

In the detergent compositions according to the present invention, it is preferred that the pH of an aqueous solution obtained by diluting the composition to 1/10 by weight with water be 4 to 10, particularly 5 to 8. The pH of the detergent compositions may be adjusted by adding an acid or alkali to the compositions.

The detergent compositions according to the present invention can be prepared in accordance with a method known per se in the art into detergents for the body, for example, hair shampoos, body soaps, face cleansers and hand soaps.

The detergent compositions according to the present invention preferably have a viscosity of 100 to 10,000 mPa·s, particularly 500 to 5,000 mPa·s at 25° C. in the case of, for example, liquid compositions such as hair shampoos from the viewpoint of ease of use.

EXAMPLE 1

Detergent compositions of their corresponding formulations shown in Table 1 were prepared in a method known per se in the art to evaluate them as to volume of foams, foam quality and a feel to the hair. The results are shown collectively in Table 1.

(Evaluation method)

One gram of a detergent composition sample was applied to a tress of each 20 g (15 cm long) of the healthy hair of Japanese women of their twenties to thirties to foam it for 30 seconds. Thereafter, the tress was rinsed and dried. Ten expert panelists were got to conduct this operation to organoleptically evaluate the sample as to volume of foams, foam quality and a feel to the hair in accordance with the following respective standards, thereby finding an average score. The sample was ranked as ◎ where the average score was at least 3.5, ○ where the average score was 2.5 to 3.4, Δ where the average score was 1.5 to 2.4, or x where the average score was at most 1.4.

(1) Volume of foams:

| | |
|---|---|
| Very good foaming was exhibited | Score 4; |
| Sufficient foaming was exhibited | Score 3; |
| Felt insufficient foaming | Score 2; |
| Scarcely foamed | Score 1. |

(2) Foam quality:

| | |
|---|---|
| Foams were creamy and very smooth | Score 4; |
| Foams were creamy and smooth | Score 3; |
| Foams were somewhat rough and slightly unsmooth | Score 2; |
| Foams were rough and unsmooth | Score 1. |

(3) Feel to the hair:

| | |
|---|---|
| Very good without creakiness and with smoothness | Score 4; |
| Good with weak creakiness and smoothness | Score 3; |
| Somewhat strongly creak and poor in smoothness | Score 2; |
| Poor due to strong creakiness | Score 1. |

TABLE 1

| | Invention product | | | Comparative product | | |
|---|---|---|---|---|---|---|
| Composition (% by weight) | 1 | 2 | 3 | 1 | 2 | 3 |
| Sodium polyoxyethylene (2) lauryl sulfate | 12.0 | 12.0 | 12.0 | 12.0 | 12.0 | 12.0 |
| Polyoxyethylene (12) lauryl ether | | 3.0 | | | 3.0 | 3.0 |
| Cationic polymer[1)] | 0.3 | | | | | |
| Dimethyl polysiloxane[2)] | | 2.0 | 2.0 | | 2.0 | |
| Cetanol | | | 0.5 | | | |
| n-Octyl glyceryl ether | 3.0 | 3.0 | 3.0 | | | 3.0 |
| Water | Bal. | Bal. | Bal. | Bal. | Bal. | Bal. |
| Volume of foams | ◎ | ◎ | ◎ | ○ | Δ | ◎ |
| Foam quality | ○ | ○ | ◎ | Δ | Δ | Δ |
| Feel to the hair | ◎ | ◎ | ◎ | X | ○ | X |

[1)]Cationized cellulose (JR400, product of Union Carbide Corp.).
[2)]KF-96 (product of Shin-Etsu Chemical Co., Ltd.).

EXAMPLE 2

A Shampoo of a formulation shown below was produced in accordance with a method known per se in the art.

| (Components) | (% by weight) |
|---|---|
| Disodium polyoxyethylene (2) lauryl sulfosuccinate | 10.0 |
| Coconut fatty acid amide propylbetaine | 3.0 |
| Cationic polymer (Gafcoat 755N, product of GAF Corp.) | 0.7 |
| Silicone emulsion (BY-22-062, product of Toray Dow Corning Co., Ltd.) | 2.0 |
| n-Octyl glyceryl ether | 5.0 |
| Sodium benzoate | 0.3 |
| Perfume base | 0.5 |
| Aqueous solution of citric acid (adjusted to pH 6.5) | q.s. |
| Purified water | Balance |

The shampoo obtained in Example 2 was excellent in foaming performance and brought about a high conditioning effect on the hair.

EXAMPLE 3

A Shampoo of a formulation shown below was produced in accordance with a method known per se in the art.

The thus-obtained shampoo was great in the volume of foams upon foaming, excellent in foaming performance and easy to use due to its moderate liquid nature.

| (Components) | (% by weight) |
|---|---|
| Sodium polyoxyethylene (3) lauryl ether sulfate | 15 |
| lauric acid diethanolamide | 4 |
| n-Octyl glyceryl ether | 3 |
| Silicone emulsion (BY-22-062, product of Toray Dow Corning Co., Ltd.) | 2.5 |
| Cationic polymer (Merquat 100, product of Calgon Corp.) | 0.5 |
| Sodium benzoate | 0.3 |

-continued

| (Components) | (% by weight) |
|---|---|
| Perfume base | 0.5 |
| Aqueous solution of citric acid (adjusted to pH 6.5) | q.s. |
| Purified water | Balance |

What is claimed is:

1. A detergent composition comprising the following components (A), (B) and (C):

(A) 0.5 to 60% by weight of a surfactant selected from the group consisting of anionic surfactants, nonionic surfactants and amphoteric surfactants;

(B) 0.01 to 20% by weight of a conditioning component which is at least one cationic polymer; and (C) 0.1 to 30% by weight of a monoglyceryl ether having a linear or branched alkyl or alkenyl group having 4 to 12 carbon atoms, wherein components (A) and (C) are different from each other.

2. The detergent composition according to claim 1, wherein the component (A) comprises an anionic surfactant and a fatty acid amide propylbetaine or fatty acid alkanolamide.

3. The detergent composition according to claim 1, wherein the anionic surfactant is a polyoxyethylene alkyl ether sulfate, polyoxyethylene alkenyl ether sulfate or alkylsulfate.

4. The detergent composition according to claim 1, wherein the component (B) additionally includes at least one selected from the group consisting of oily substances and silicones.

5. The detergent composition according to claim 2, wherein the component (B) additionally includes at least one selected from the group consisting of oily substances and silicones.

6. The detergent composition according to claim 3, wherein the component (B) additionally includes at least one selected from the group consisting of oily substances and silicones.

7. The detergent composition according to claim 1, wherein (B)/(A) is 0.002 to 2, (C)/(A)is 0.002 to 2, and (C)/(B) is 0.01 to 100.

8. The detergent composition according to claim 7, wherein (B)/(A) is 0.02 to 0.5, (C)/(A)is 0.02 to 0.5, and (C)/(B) is 0.1 to 10.

9. The detergent composition according to claim 4, wherein component (B) comprises said cationic polymer and silicone in an amount of 0.1 to 5% by weight.

10. The detergent composition according to claim 5, wherein component (B) comprises said cationic polymer and silicone in an amount of 0.1 to 5% by weight.

11. The detergent composition according to claim 6, wherein component (B) comprises said cationic polymer and silicone in an amount of 0.1 to 5% by weight.

* * * * *